US011657758B2

(12) United States Patent
Park

(10) Patent No.: US 11,657,758 B2
(45) Date of Patent: May 23, 2023

(54) ELECTROLUMINESCENT DISPLAY DEVICE AND METHOD FOR DRIVING SAME

(71) Applicant: LG DISPLAY CO., LTD., Seoul (KR)

(72) Inventor: Joon Min Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/521,422

(22) Filed: Nov. 8, 2021

(65) Prior Publication Data

US 2022/0199015 A1 Jun. 23, 2022

(30) Foreign Application Priority Data

Dec. 17, 2020 (KR) ..... 10-2020-0177259

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01); *G09G 2320/0233* (2013.01); *G09G 2320/0252* (2013.01); *G09G 2330/021* (2013.01)

(58) Field of Classification Search
CPC ..... G09G 3/3233; G09G 2300/0842; G09G 2310/08; G09G 2320/0233; G09G 2320/0252; G09G 2330/021
See application file for complete search history.

(56) References Cited

U.S. PATENT DOCUMENTS

2006/0022933 A1* 2/2006 Endo ..... G09G 3/3614 345/98
2017/0200412 A1* 7/2017 Gu ..... G09G 3/3266
2019/0051246 A1* 2/2019 Kim ..... G09G 3/3258

FOREIGN PATENT DOCUMENTS

KR 10-2007-0118451 A 12/2007
KR 10-2012-0060451 A 6/2012
KR 10-2019-0138395 A 12/2019

OTHER PUBLICATIONS

Dictionary.com, "neighboring," in Dictionary.com Unabridged. Source location: Random House, Inc. http://dictionary.reference.com/browse/neighboring, Apr. 30, 2014, p. 1.*

* cited by examiner

*Primary Examiner* — Jeff Piziali
(74) *Attorney, Agent, or Firm* — Polsinelli PC

(57) ABSTRACT

An electroluminescent display device includes a display panel including a plurality of pixels each including a light-emitting element driven according to a driving current flowing between a high-level power supply voltage and a low-level power supply voltage, and an EVDD adjustment circuit configured to cut off the high-level power supply voltage for a black period in which emission of light from the light-emitting element stops in one frame such that the high-level power supply voltage is not applied to the pixels.

14 Claims, 8 Drawing Sheets

ELECTROLUMINESCENT DISPLAY DEVICE AND METHOD FOR DRIVING SAME

CROSS-REFERENCE TO RELATED APPLICATION

This application claims the benefit of Korean Patent Application No. 10-2020-0177259, filed on Dec. 17, 2020, which is hereby incorporated by reference in its entirety as if fully set forth herein.

BACKGROUND

Field of the Disclosure

The present disclosure relates to an electroluminescent display device and a method for driving the same.

Description of the Background

An electroluminescent display device is a hold type display device and thus has a motion picture response time (MPRT) longer than that of an impulse type display device. Accordingly, motion blurring may occur therein.

Although a technique of inserting black image data to improve MPRT and minimize motion blurring is known, this technique has problems that it is difficult to represent a stable black image due to charging timing interference between the black image and an input image, and a bright line/dark line different from a normal luminance is visibly recognized in specific pixel lines.

SUMMARY

Accordingly, the present disclosure is to provide an electroluminescent display device and a method for driving the same to eliminate charging timing interference between a black image and an input image.

An electroluminescent display device according to an aspect of the present disclosure includes a display panel including a plurality of pixels each including a light-emitting element driven according to a driving current flowing between a high-level power supply voltage and a low-level power supply voltage, and an EVDD adjustment circuit configured to cut off the high-level power supply voltage for a black period in which emission of light from the light-emitting element stops in one frame such that the high-level power supply voltage is not applied to the pixels.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
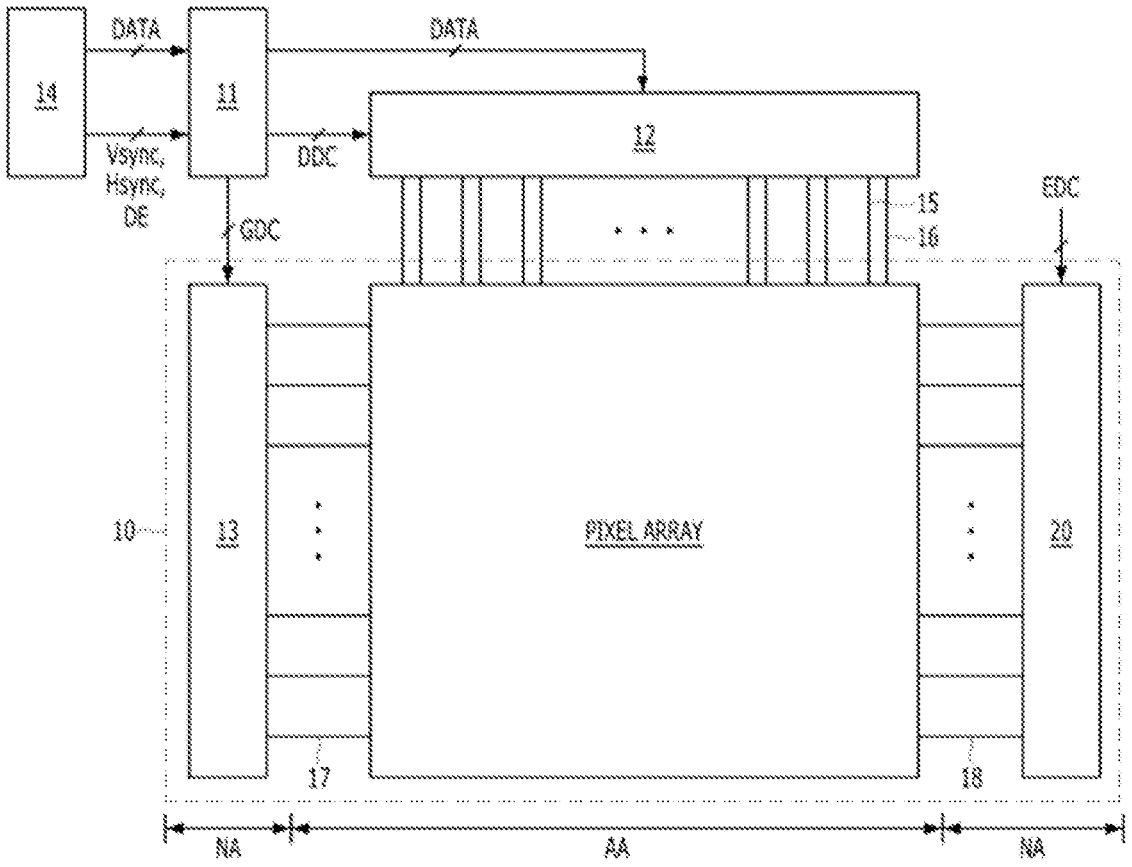
FIG. 1 is a diagram showing an electroluminescent display device according to an aspect of the present disclosure.

The advantages and features of the present disclosure and the way of attaining the same will become apparent with reference to aspects described below in detail in conjunction with the accompanying drawings. The present disclosure, however, is not limited to the aspects disclosed hereinafter and may be embodied in many different forms. Rather, these exemplary aspects are provided so that this disclosure will be through and complete and will fully convey the scope to those skilled in the art. Thus, the scope of the present disclosure should be defined by the claims.

The shapes, sizes, ratios, angles, numbers, and the like, which are illustrated in the drawings in order to describe aspects of the present disclosure, are merely given by way of example, and therefore, the present disclosure is not limited to the illustrations in the drawings. The same elements are designated by the same reference numerals throughout the specification. In the present disclosure, when the terms "comprise", "include", and the like are used, other elements may be added unless the term "only" is used. An element described in the singular form is intended to include a plurality of elements unless the context clearly indicates otherwise.

In the interpretation of constituent elements included in the various aspects of the present disclosure, the constituent elements are interpreted as including an error range even if there is no explicit description thereof.

When describing positional relationships, for example, when the positional relationship between two parts is described using "on", "above", "below", "beside", or the like, one or more other parts may be located between the two parts unless the term "directly" or "closely" is used.

In the description of the various aspects of the present disclosure, although terms such as "first" and "second" may be used to describe various elements, these terms are merely used to distinguish the same or similar elements from each other. Therefore, in the present disclosure, an element modified by "first" may be the same as an element modified by "second" within the technical scope of the present disclosure unless mentioned otherwise.

The same reference numbers will be used throughout this specification to refer to the same or like parts.

Although a pixel circuit and a gate driver formed on a substrate of a display panel may be implemented as TFTs in an n-type metal oxide semiconductor field effect transistor (MOSFET) structure in the present disclosure, the present disclosure is not limited thereto and they may be implemented as TFTs in a p-type MOSFET structure. A TFT is a tri-electrode element including a gate, a source, and a drain. The source is an electrode that supplies carriers to the TFT. Carriers flow from the source in the TFT. The drain is an electrode through which carriers are discharged from the TFT. That is, carriers flow from the source to the drain in a MOSFET. In the case of an n-type TFT (NMOS), a source voltage is lower than a drain voltage such that electrons can flow from the source to the drain because the electrons are carriers. Current flows from the drain to the source in the n-type TFT because electrons flow from the source to the drain. On the other hand, in the case of a p-type TFT, a source voltage is higher than a drain voltage such that holes can flow from the source to the drain because the holes are carriers. In the p-type TFT, current flows from the source to the drain because holes flow from the source to the drain. It should be noted that the source and the drain of the MOSFET are not fixed. For example, the source and the drain of the MOSFET may change according to applied voltage. Accordingly, one of the source and the drain is described as a first electrode and the other is described as a second electrode in description of aspects of the present disclosure.

Hereinafter, aspects of the present disclosure will be described in detail with reference to the attached drawings. Although an organic electroluminescent display device will be mainly described as an electroluminescent display device in the following aspects, the technical spirit of the present disclosure is not limited to organic electroluminescent display devices and can also be applied to inorganic electroluminescent display devices including inorganic light-emitting materials.

In the following description, a detailed description of known functions or configurations incorporated herein will be omitted when it may obscure the subject matter of the present disclosure.

Figure 2:
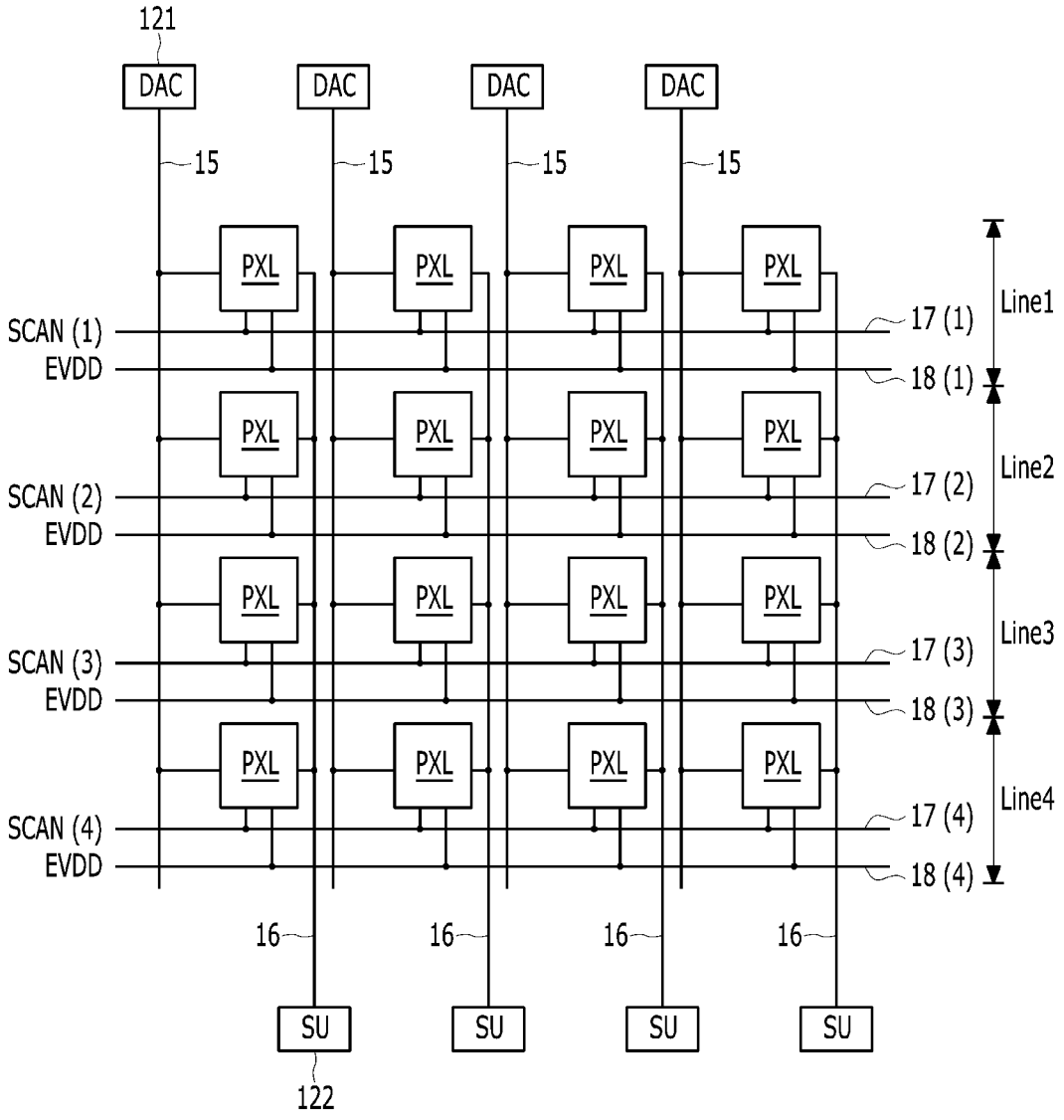
FIG. 2 is a diagram showing a pixel array of FIG. 1 in detail.

FIG. 1 is a diagram showing an electroluminescent display device according to an aspect of the present disclosure. FIG. 2 is a diagram showing a pixel array of FIG. 1 in detail. In addition, FIG. 3 is a diagram showing one pixel of FIG. 2.

Figure 3:
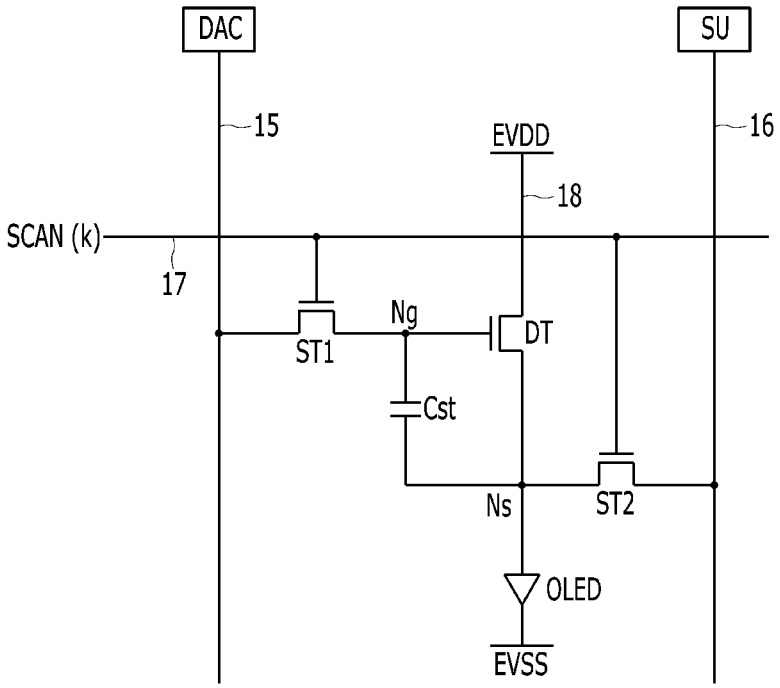
FIG. 3 is a diagram showing one pixel of FIG. 2.

Referring to FIG. 1 to FIG. 3, an electroluminescent display device according to an aspect of the present disclosure includes a display panel 10, a timing controller 11, panel driving circuits 12 and 13, and an EVDD adjustment circuit 20. The panel driving circuits 12 and 13 include a data driver 12 that drives data lines 15 of the display panel 10 and a gate driver 13 that drives gate lines 17 of the display panel 10.

The display panel 10 may include a plurality of data lines 15, reference voltage lines 16, a plurality of gate lines 17, and a plurality of EVDD branch lines 18. In addition, pixels PXL may be disposed at intersections of these signal lines 15 to 18. The pixels PXL disposed in a matrix form may constitute a pixel array in a display area AA of the display panel 10.

In the pixel array, the pixels PXL may be divided by pixel lines in one direction. When the pixel array includes a first pixel line including first pixels neighboring in a first direction (horizontal direction) and a second pixel line including second pixels neighboring in the first direction, the first pixel line and the second pixel line may be distinguished from each other in a second direction (vertical direction) perpendicular to the first direction. For example, the pixels PXL may be divided into a plurality of pixel lines Line 1 to Line 4 in a data line extending direction (or vertical direction). Here, a pixel line is not a physical signal line and means a set of pixels PXL adjacently disposed in a horizontal direction. Accordingly, pixels PXL constituting the same pixel line may be connected to the same gate line 17 and the same EVDD branch line 18.

In the pixel array, each pixel PXL may be connected to a digital-to-analog converter (DAC) 121 through the data line 15 and may be connected to a sensing unit (SU) 122 through the reference voltage line 16. The reference voltage line 16 may be additionally connected to the DAC 121 in order to supply a reference voltage. The DAC 121 and the sensing unit 122 may be embedded in the data driver 12, but the present disclosure is not limited thereto.

In the pixel array, pixels PXL may be provided with a high-level power supply voltage EVDD through any of EVDD branch lines 18(1) to 18(4), as shown in FIG. 2. In addition, each pixel PXL may be provided with a scan signal SCAN(1) to SCAN(4) through any of gate lines 17(1) to 17(4).

Each pixel may be implemented as shown in FIG. 3. A pixel PXL disposed in a k-th (k being an integer) pixel line may include an OLED, a driving thin film transistor (TFT) DT, a storage capacitor Cst, a first switching TFT ST1, and a second switching TFT ST2, and the first switching TFT ST1 and the second switching TFT ST2 may be connected to the same gate line 17.

The OLED is a light-emitting element that operates according to driving current flowing between the high-level power supply voltage EVDD and a low-level power supply voltage EVSS. The OLED includes an anode connected to a source node Ns, a cathode connected to an input terminal to which the low-level power supply voltage EVSS is applied, and an organic compound layer provided between the anode and the cathode.

The driving TFT DT is a driving element that controls driving current flowing through the OLED according to a voltage difference between a gate node Ng and the source node Ns. The driving TFT DT includes a gate electrode connected to the gate node Ng, a first electrode connected to an input terminal to which the high-level power supply voltage EVDD is applied, and a second electrode connected to the source node Ns. The storage capacitor Cst is connected between the gate node Ng and the source node Ns and stores a gate-source voltage of the driving TFT DT.

The first switching TFT ST1 is turned on according to a scan signal SCAN(k) and applies a data voltage charged in the data line 15 to the gate node Ng. The first switching TFT ST1 includes a gate electrode connected to the gate line 17, a first electrode connected to the data line 15, and a second electrode connected to the gate node Ng. The second switching TFT ST2 is turned on according to the scan signal SCAN(k) and applies a reference voltage charged in the reference voltage line 16 to the source node Ns or transfers voltage variation at the source node Ns according to the driving current to the reference voltage line 16. The second switching TFT ST2 includes a gate electrode connected to the gate line 17, a first electrode connected to the reference voltage line 16, and a second electrode connected to the source node Ns.

The number of gate lines 17 connected to each pixel PXL may depend on the structure of the pixel PXL. For example, in the case of a 2-scan pixel structure in which the first switching TFT ST1 and the second switching TFT ST2 are differently driven, the number of gate lines connected to each pixel PXL is 2. In the 2-scan pixel structure, each gate line 17 may include a first gate line to which a scan signal is applied and a second gate line to which a sense signal is applied. Accordingly, the technical spirit of the present disclosure is not limited to a pixel structure and the number of gate lines.

The timing controller 11 may generate a data timing control signal DDC for controlling operation timing of the data driver 12, a gate timing control signal GDC for controlling operation timing of the gate driver 13, and a power timing control signal EDC for controlling operation timing of the EVDD adjustment circuit 20 on the basis of timing signals such as a vertical synchronization signal Vsync, a horizontal synchronization signal Hsync, and a data enable signal DE input from a host system 14. The gate timing control signal GDC may include a gate start signal and a gate shift clock signal. The data timing control signal DDC may include a source start pulse signal, a source sampling clock signal, and a source output enable signal. The power timing control signal EDC may include a start signal, an end signal, and a clock signal (refer to FIG. 8) and may further include a common start signal (refer to FIG. 11).

The timing controller 11 outputs image data input from the host system 14 to the data driver 12. The timing controller 11 may control driving of an input image and a black image for pixel lines of the display panel 10 based on the timing control signals GDC, DDC, and EDC. The input image and the black image may be temporally divided in one frame and displayed on a screen. The pixels PXL emit light when the input image is displayed and stop emission of light when the black image is displayed. The high-level power supply voltage EVDD is blocked such that it is not applied to the pixels PXL when the black image is displayed.

The timing controller 11 may adjust an emission duty by controlling display timing of the black image (i.e., EVDD off timing) in one frame. The timing controller 11 may control black image display timing in one frame in association with motion of input image data DATA. The timing controller 11 may detect the motion of the input image data DATA through various known image processing techniques and then advance the black image display timing in one frame as variation in the motion of the input image data DATA increases to reduce the emission duty. Accordingly, MPRT performance can be improved and motion blurring can be mitigated in case of rapid image change. On the other hand, if there is no image change, the timing controller 11 may delay the black image display timing to increase the emission duty.

The gate driver 13 generates a scan signal on the basis of the gate timing control signal GDC from the timing controller 11. The gate driver 13 may be embedded in a non-display area NA of the display panel 10 according to a gate in panel (GIP) structure.

The data driver 12 includes a plurality of DACs 121 and a plurality of sensing units 122. The DACs 121 convert image data DATA into a data voltage on the basis of the data timing control signal DDC from the timing controller 11 and then output the data voltage to the data lines 15.

The sensing units 122 sense a pixel current or a pixel node voltage in which driving characteristics (i.e., the threshold voltage or electron mobility of the driving TFT and the threshold voltage of the OLED) of the pixels PXL have been reflected through the reference voltage lines 16. The sensing units 122 may be omitted as necessary.

Figure 4:
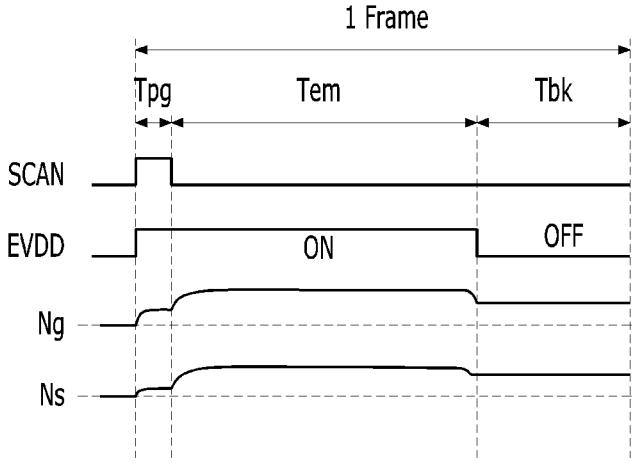
FIG. 4 is a diagram showing driving timing for the pixel of FIG. 3.
Figure 5:
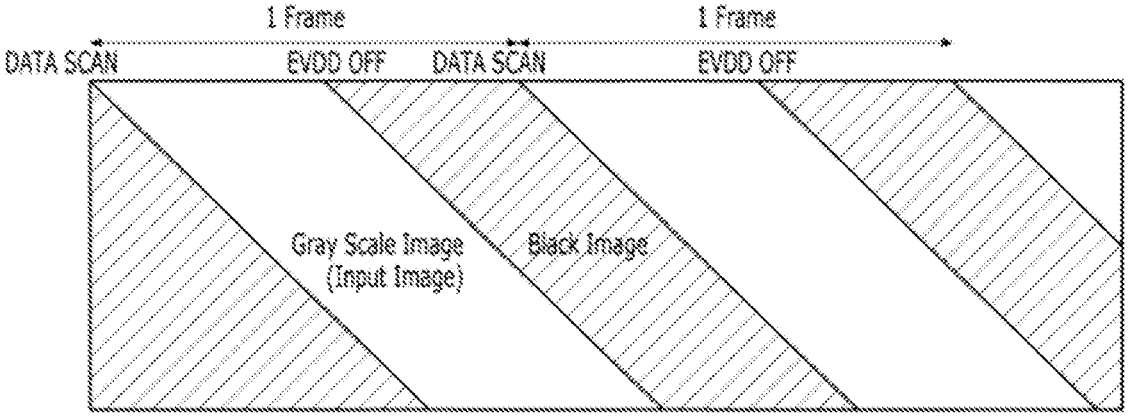
FIG. 5 is a diagram showing realization of a black image through EVDD off.

FIG. 4 is a diagram showing driving timing for the pixel of FIG. 3 and FIG. 5 is a diagram showing realization of a black image through EVDD off.

Referring to FIG. 4, one frame includes a programming period Tpg, an emission period Tem, and a black period Tbk. The programming period Tpg and the emission period Tem may correspond to input image display timing (i.e., EVDD on timing) and the black period Tbk may correspond to black image display timing (e.g., EVDD off timing).

The gate-source voltage of the driving TFT is set in synchronization with a scan signal SCAN in the programming period Tpg. The OLED emits light according to driving current flowing through the driving TFT in the emission period Tem. Application of the high-level power supply voltage EVDD to the driving TFT is cancelled and emission of light from the OLED stops in the black period.

Referring to FIG. 5, the black image may be sequentially represented for pixel lines because the high-level power supply voltage EVDD is cut off in the black period Tbk. In other words, the display panel may include the first pixel line including first pixels and the second pixel line including second pixels adjacent to the first pixels. In this case, a timing at which the high-level power supply voltage EVDD is cut off may be adjusted differently in the first pixel line and the second pixel line. Accordingly, charging interference between a black image and an input image does not occur, stable black can be represented, and a problem with respect to visibility of a bright line/dark line occurring in specific pixel lines can be solved.

Figure 6:
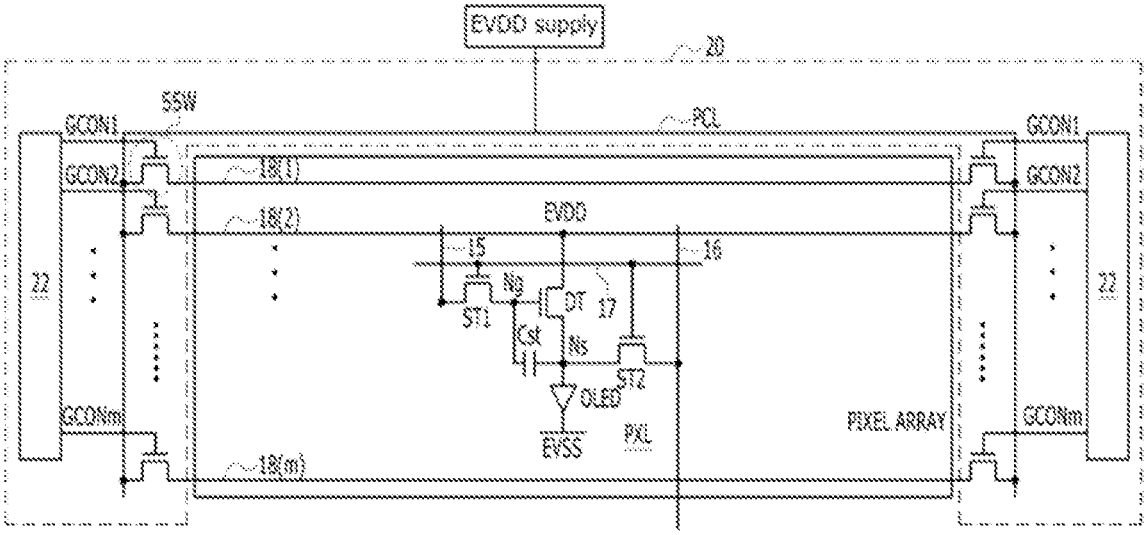
FIG. 6 is a diagram showing arrangement of an EVDD adjustment circuit for turning on and off an EVDD in units of a pixel line.

FIG. 6 is a diagram showing arrangement of the EVDD adjustment circuit 20 for turning on/off the EVDD in units of a pixel line.

Referring to FIG. 6, EVDD branch lines 18(1) to 18(*m*) connected to the pixels PXL may be positioned in the display area and an EVDD common line PCL connected to an EVDD supply may be positioned in the non-display area outside the display area. The EVDD common line PCL may be implemented as a short bar surrounding the display area and connected to the EVDD supply.

The EVDD branch lines 18(1) to 18(*m*) are connected in parallel to the EVDD common line PCL. Since the high-level power supply voltage EVDD that is a current supply source is applied from the EVDD common line PCL to the EVDD branch lines 18(1) to 18(*m*) in parallel, luminance deviation by location due to EVDD drop is reduced.

Referring to FIG. 6, the EVDD adjustment circuit 20 may be positioned in the non-display area of the display panel. The EVDD adjustment circuit 20 may include a plurality of control transistors SSW connected between the EVDD common line PCL and the EVDD branch lines 18, and a control signal generation circuit 22 that generates EVDD control signals GCON1 to GCONm to be applied to the gate electrodes of the control transistors SSW.

Figure 7:
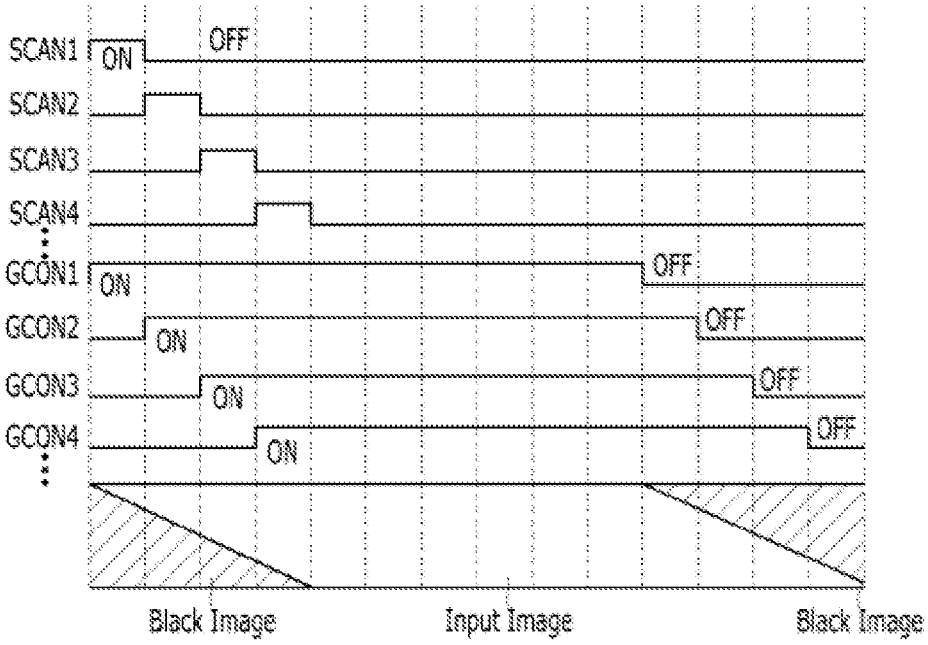
FIG. 7 is a diagram showing EVDD control signals for sequentially turning on and off the EVDD in units of a pixel line.

FIG. 7 is a diagram showing EVDD control signals for sequentially turning on and off the EVDD in units of a pixel line.

Referring to FIG. 7, the control transistors SSW are sequentially turned off in response to the EVDD control signals GCON1 to GCONm such that supply of EVDD to pixel lines is sequentially cut off and thus sequential black periods can be set in the pixel lines.

Referring to FIG. 7, the control transistors SSW are sequentially turned on in response to the EVDD control signals GCON1 to GCONm such that the EVDD is sequentially supplied to the pixel lines and thus sequential emission periods can be set in the pixel lines.

The control transistors SSW are simultaneously turned on in response to the EVDD control signals GCON1 to GCONm such that EVDD is simultaneously supplied to the pixel lines and thus emission periods can be simultaneously set in the pixel lines. Such simultaneous emission operation is performed at the time of initial start-up immediately after system power is applied, and thus charging characteristics of the panel can be stabilized within a short time. When the charging characteristics are stabilized, simultaneous emission operation may switch to sequential emission operation.

Figure 8:
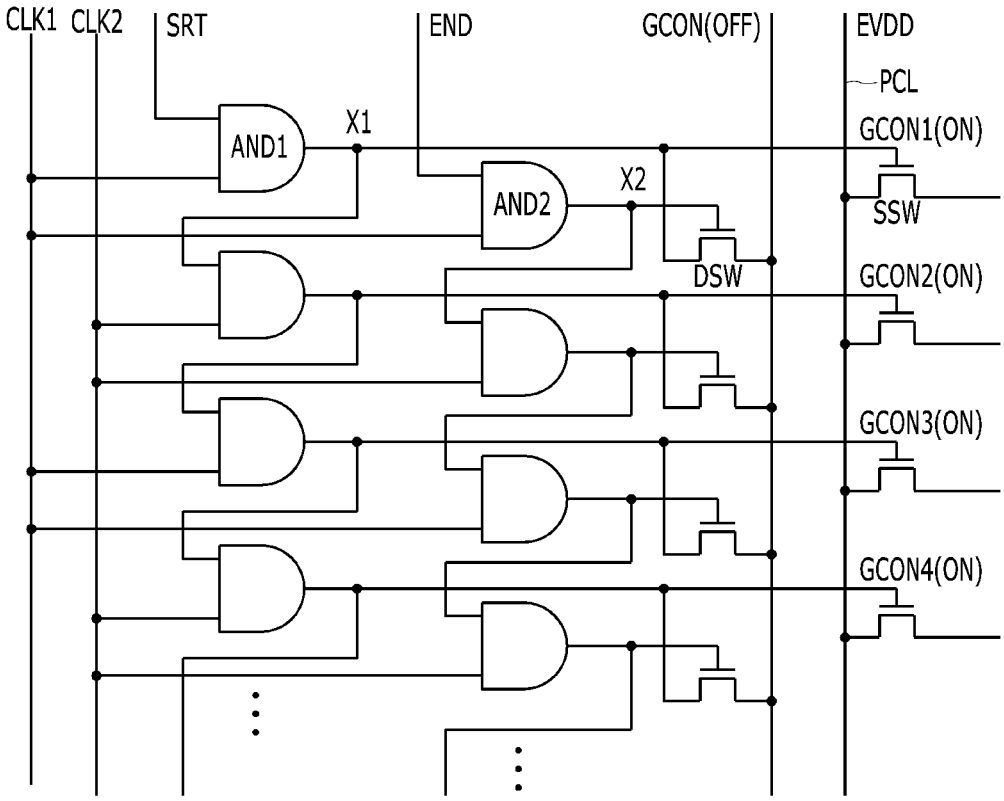
FIG. 8 is a diagram showing a configuration of the EVDD adjustment circuit of FIG. 6.
Figure 9:
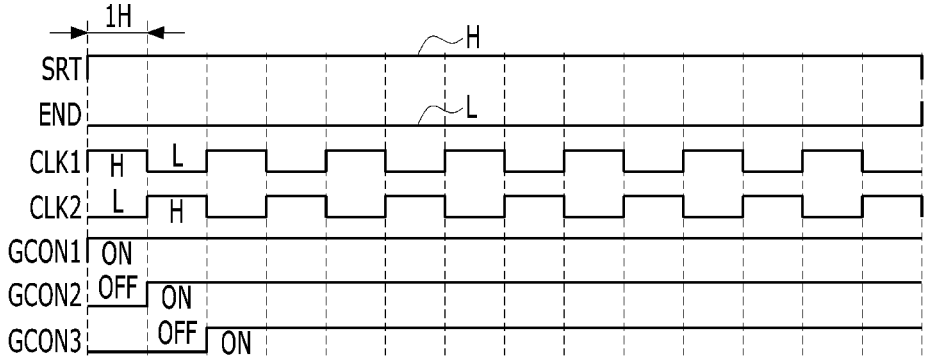
FIG. 9 is a diagram showing sequentially turning on EVDD control signals in the EVDD adjustment circuit of FIG. 8.
Figure 10:
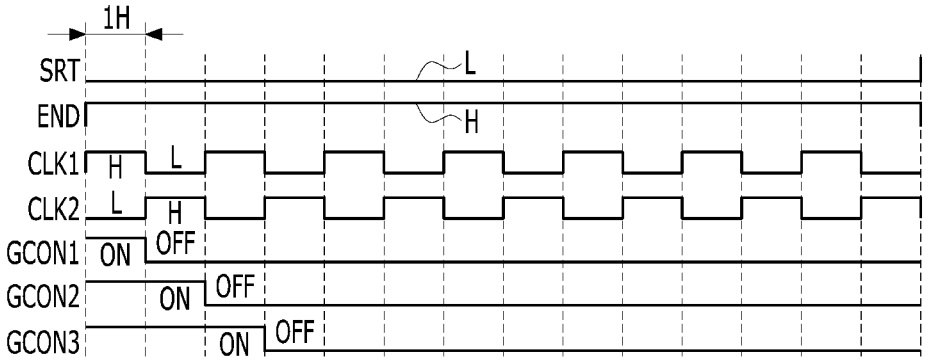
FIG. 10 is a diagram showing sequentially turning off EVDD control signals in the EVDD adjustment circuit of FIG. 8.

FIG. 8 is a diagram showing a configuration of the EVDD adjustment circuit of FIG. 6. FIG. 9 is a diagram showing sequentially turning on EVDD control signals in the EVDD adjustment circuit of FIG. 8. In addition, FIG. 10 is a diagram showing sequentially turning off EVDD control signals in the EVDD adjustment circuit of FIG. 8.

Referring to FIG. 8, the EVDD adjustment circuit 20 includes a plurality of first operation circuits AND1, a plurality of discharge transistors DSW, and a plurality of second operation circuits AND2.

The first operation circuits AND1 are connected in a cascading manner to receive outputs of preceding stages (i.e., carry outputs) as a start signal SRT. In addition, the first operation circuits AND1 perform an AND operation on the start signal SRT and a clock signal CLK1/CLK2 and sequentially output EVDD control signals GCON1 to GCONm at an on level. Each first operation circuit AND1 performs an AND operation on the start signal SRT at the on level and the clock signal CLK1/CLK2 alternating between the on level and an off level and outputs any one of the EVDD control signals GCON1 to GCONm as the on level through a first output terminal Xl.

The plurality of discharge transistors DSW is connected between the first output terminals X1 of the first operation circuits AND1 and an off voltage source GCON(OFF). The off voltage source GCON(OFF) provides a voltage level for turning off the EVDD control signals GCON1 to GCONm, that is, the off level.

The second operation circuits AND2 are connected in a cascading manner to receive outputs of preceding stages as an end signal END. In addition, the second operation circuits AND2 perform an AND operation on the end signal END and the clock signal CLK1/CLK2 and output operation result signals through second output terminals X2. The operation result signals from the second output terminals X2 sequentially turn on the discharge transistors DSW such that the EVDD control signals GCON1 to GCONm at the off level are sequentially output. Each second operation circuit AND2 performs an AND operation on the end signal END at the on level and the clock signal CLK1/CLK2 to turn on the discharge transistor DSW such that any one of the EVDD control signals GCON1 to GCONm is output at the off level through the first output terminal Xl.

Referring to FIG. 8 and FIG. 9, the start signal SRT at the on level corresponds to an emission period prior to a black period. In the emission period, the control transistors SSW are sequentially turned on in response to the sequentially output EVDD control signals GCON1 to GCONm at the on level. The EVDD branch lines 18 are sequentially connected to the EVDD common line PCL according to the turn-on operation of the control transistors SSW. Accordingly, pixel lines including the EVDD branch lines 18 sequentially emit light to reproduce an input image.

Referring to FIG. 8 and FIG. 10, the end signal END at the on level corresponds to the black period. In the black period, the control transistors SSW are sequentially turned off in response to the sequentially output EVDD control signals GCON1 to GCONm at the off level. Electrical connection of the EVDD branch lines 18 to the EVDD common line PCL is sequentially cancelled according to the turn-off operation of the control transistors SSW. Accordingly, the pixel lines including the EVDD branch lines 18 sequentially stop emission of light to reproduce a black image.

Figure 11:
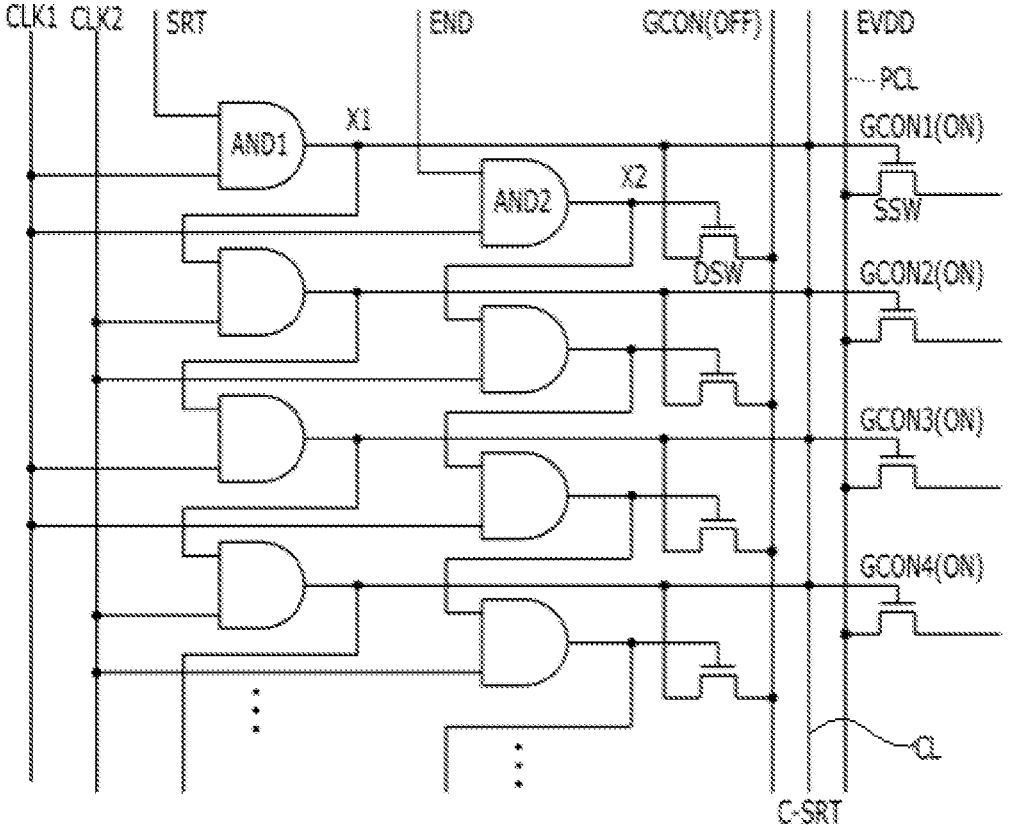
FIG. 11 is a diagram showing another configuration of the EVDD Adjustment circuit of FIG. 6.
Figure 12:
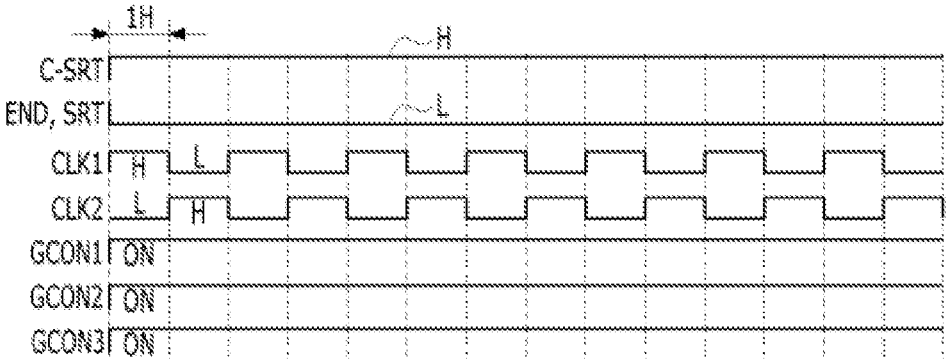
FIG. 12 is a diagram showing simultaneously turning on EVDD control signals in the EVDD adjustment circuit of FIG. 11.

FIG. 11 is a diagram showing another configuration of the EVDD adjustment circuit of FIG. 6 and FIG. 12 is a diagram showing simultaneously turning on EVDD control signals in the EVDD adjustment circuit of FIG. 11.

At the time of initial start-up immediately after system power is applied, the EVDD control signals GCON1 to GCONm at the on level may be simultaneously generated. To this end, the control signal generation circuit 22 may further include a common start line CL through which a common start signal C-SRT at the on level is applied to the first output terminals X1, as shown in FIG. 11. The common start signal C-SRT at the on level is commonly applied to the gate electrodes of the control transistors SSW.

To sequentially generate the EVDD control signals GCON1 to GCONm at the off level, the control signal generation circuit 22 includes discharge transistors DSW connected between the first output terminals X1 and the off voltage source GCON(OFF), and second operation circuits AND2. Each second operation circuit AND2 performs an AND operation on the end signal END at the on level and the clock signal CLK1/CLK2 to turn on the discharge transistor DSW corresponding thereto such that any one of the EVDD control signals GCON1 to GCONm is output at the off level through the first output terminal Xl.

Referring to FIG. 11 and FIG. 12, the common start signal C-SRT at the on level corresponds to an emission period prior to a black period. In the emission period, the control transistors SSW are simultaneously turned on in response to the simultaneously output EVDD control signals GCON1 to GCONm at the on level. The EVDD branch lines 18 are simultaneously connected to the EVDD common line PCL according to the turn-on operation of the control transistors SSW. Accordingly, pixel lines including the EVDD branch lines 18 simultaneously emit light to reproduce an input image.

Referring to FIG. 10 and FIG. 11, the end signal END at the on level corresponds to the black period. In the black period, the control transistors SSW are sequentially turned off in response to the sequentially output EVDD control signals GCON1 to GCONm at the off level. Electrical connection of the EVDD branch lines 18 to the EVDD common line PCL is sequentially cancelled according to the turn-off operation of the control transistors SSW. Accordingly, the pixel lines including the EVDD branch lines 18 sequentially stop emission of light to reproduce a black image.

According to the aspects of the present disclosure, the following advantages are obtained.

According to the aspects of the present disclosure, the high-level power supply voltage is cut off in a black period in one frame such that the high-level power supply voltage is not applied to pixels to represent a black image. According to the aspects of the present disclosure, additional black image data is not charged in pixels. Accordingly, charging timing interference between a black image and an input image is eliminated and the problem that a bright line/dark line different from normal luminance is visually recognized in specific pixel lines is solved.

It will be appreciated by persons skilled in the art that the effects that can be achieved with the present disclosure are not limited to what has been particularly described hereinabove and other advantages of the present disclosure will be more clearly understood from the following detailed description.

Those skilled in the art will appreciate that various modifications and variations can be made in the present disclose without departing from the spirit or scope of the disclosure. Accordingly, the scope of the present disclosure should be determined by the appended claims and their legal equivalents, not by the above description.

What is claimed is:

1. An electroluminescent display device, comprising:

a display panel including a plurality of pixels and each pixel including a light-emitting element driven according to a driving current flowing between a high-level power supply voltage and a low-level power supply voltage; and a circuit configured to cut off the high-level power supply voltage for a black period in which emission of light from the light-emitting element stops in one frame such that the high-level power supply voltage is not applied to the plurality of pixels, wherein the circuit is configured to cut off the high-level power supply voltage using at least one AND operation between an end signal and a clock signal, the end signal corresponding to the black period.

2. The electroluminescent display device of claim 1, wherein the display panel includes a first pixel line including first pixels in a first direction and a second pixel line including second pixels in the first direction.

3. The electroluminescent display device of claim 2, wherein the first pixel line and the second pixel line are distinguished from each other in a second direction perpendicular to the first direction, and a timing at which the high-level power supply voltage is cut off is different in the first pixel line and the second pixel line.

4. The electroluminescent display device of claim 1, wherein the display panel further includes a plurality of voltage lines connected to the pixels in a display area and a common voltage line disposed in a non-display area outside the display area.

5. The electroluminescent display device of claim 4, wherein the plurality of voltage lines are connected in parallel to the common line.

6. The electroluminescent display device of claim 4, wherein the circuit includes:

a plurality of control transistors connected between the common line and the voltage lines; and a control circuit configured to generate control signals to be applied to gate electrode of each of the plurality of control transistors.

7. The electroluminescent display device of claim 6, wherein the control transistors are sequentially turned off in response to the control signals such that the black period is set.

8. The electroluminescent display device of claim 6, wherein the control transistors are sequentially turned on in response to the control signals such that an emission period is set prior to the black period.

9. The electroluminescent display device of claim 6, wherein the control transistors are simultaneously turned on in response to the control signals such that an emission period is set prior to the black period.

10. The electroluminescent display device of claim 6, wherein the at least one AND operation includes a first AND operation and a second AND operation, and the control circuit includes:

a first circuit configured to perform the first AND operation on a start signal at an on level and the clock signal alternating between the on level and an off level to output any one of the control signals at the on level through a first output terminal;

a discharge transistor connected between the first output terminal and an off voltage source; and a second circuit configured to perform the second AND operation on the end signal at the on level and the clock signal to turn on the discharge transistor such that any one of the control signals is output at the off level through the first output terminal, wherein the first output terminal is connected to any one of gate electrodes of the control transistors.

11. The electroluminescent display device of claim 6, wherein the control circuit includes:

a common start line commonly connected to the gate electrodes of the control transistors and used to apply a common start signal at the on level to a first output terminal;

a discharge transistor connected between the first output terminal and an off voltage source; and a second operation circuit configured to perform the at least one AND operation on an end signal at an on level and a clock signal to turn on the discharge transistor such that any one of the control signals is output at an off level through the first output terminal.

12. The electroluminescent display device of claim 11 wherein the end signal at the on level corresponds to the black period, and the start signal at the on level or the common start signal at the on level corresponds to an emission period prior to the black period.

13. A method for driving an electroluminescent display device including a plurality of pixels each including a light-emitting element driven according to a driving current flowing between a high-level power supply voltage and a low-level power supply voltage, the method comprising;

supplying the high-level power supply voltage to the pixels for an emission period in which the light-emitting element emits light in one frame; and cutting off, using an AND operation, the high-level power supply voltage for a black period in which emission of light from the light-emitting element stops in the one frame such that the high-level power supply voltage is not applied to the pixels, wherein the AND operation is between an end signal and a clock signal, the end signal corresponding to the black period.

14. The method of claim 13, wherein a timing at which the high-level power supply voltage is cut off is sequential in units of a pixel line.

* * * * *